United States Patent [19]

Darda

[11] 3,957,309

[45] May 18, 1976

[54] APPARATUS FOR MECHANICALLY BREAKING UP ROCK

[76] Inventor: Helmut Darda, Im Tal, 7712 Blumberg, Germany

[22] Filed: Mar. 6, 1974

[21] Appl. No.: 448,568

[30] Foreign Application Priority Data

Mar. 9, 1973 Germany ..... 2311723

[52] U.S. Cl. ..... 299/22

[51] Int. Cl.[2] ..... E21C 37/06

[58] Field of Search ..... 299/22, 23; 144/193 R, 144/193 A; 125/23 R, 1

[56] References Cited

UNITED STATES PATENTS

| | | | |
|---|---|---|---|
| 2,595,565 | 5/1952 | Buttrick | 299/91 |
| 3,414,328 | 12/1968 | Darda | 299/22 |
| 3,526,434 | 9/1970 | Darda | 299/22 |
| 3,558,191 | 1/1971 | Fletcher et al. | 299/23 X |
| 3,572,840 | 3/1971 | Fletcher | 299/23 |
| 3,576,348 | 4/1971 | Zielinski | 299/23 |

*Primary Examiner*—Frank L. Abbott
*Assistant Examiner*—William F. Pate, III
*Attorney, Agent, or Firm*—Haseltine, Lake & Waters

[57] ABSTRACT

Apparatus for mechanically breaking up rock comprises a hydraulically operated piston-cylinder assembly, a slider wedge connected to the piston rod of the assembly and presser cheeks mounted on a tubular extension of the cylinder of the assembly for engagement with opposite sides of the slider wedge. A web extending transversely within the outer end of the tubular extension has an elongate opening through which "T"-shaped heads of the presser cheeks can be inserted into the tubular extension so that, on rotation through 90° about the longitudinal axes of the presser cheeks, the heads are locked behind the edges of the elongate opening but capable of lateral movement along the opening as a result of axial movement of the slider wedge. Preferably, the lateral extremities of the T-shaped heads are seated between two pairs of semicircular shaped supporting plates which are retained within the tubular extension by the transversely extending web. The presser cheeks are resiliently clamped to the slider wedge by a C-shaped retaining spring which is rotatable within the tubular extension for alignment of the gap with the elongate opening in the transverse web to allow removal of the heads of the presser cheeks. Alternatively, the presser cheeks are clamped by the cranked ends of spring-loaded pins which may be rotated so that the cranked ends clear the presser cheeks.

13 Claims, 7 Drawing Figures

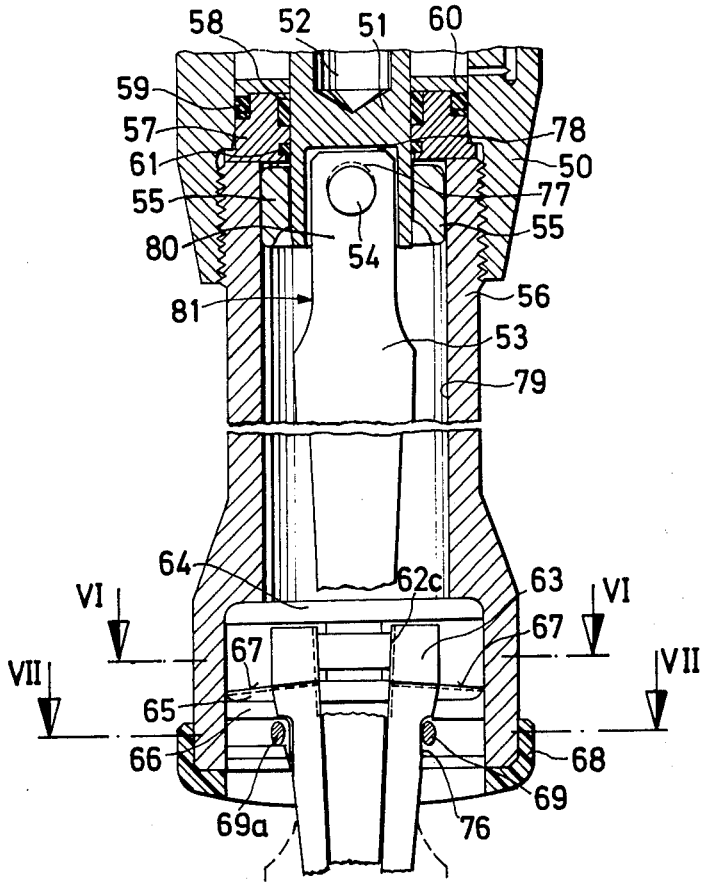
FIG.5
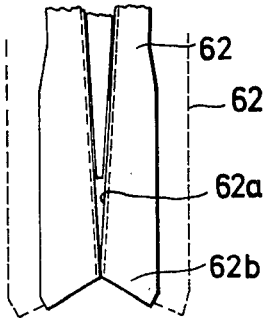

APPARATUS FOR MECHANICALLY BREAKING UP ROCK

BACKGROUND OF THE INVENTION

A conventional rock breaking apparatus comprises a hydraulically operated piston-cylinder assembly, a slider wedge which is reciprocable by means of a piston rod connected to the piston of the piston-cylinder assembly, and presser checks which are insertable in holes drilled in rock and have heads which are attached to the cylinder of the piston-cylinder assembly and bearing surfaces engageable with the outer surfaces of the slider wedge so as to be laterally movable on reciprocation of the slider wedge to split the rock.

Apparatus constructed in this manner can generate breaking or splitting forces of the order of magnitude of 300 tons, and more, so as to enable clumps of rock, concrete parts or the like to be split and comminuted without the use of explosives. In spite of the large splitting forces generated, the diameter of the apparatus, in the vicinity of the presser cheeks, is only of the order of magnitude of 45 mm, and so the necessary drill holes can be made inexpensively.

It has been found to be advantageous to releasably connect the presser cheeks and/or the slider wedge to the piston-cylinder assembly so that, if necessary, these parts, which are subjected to high loads, can be replaced. Also, it is often desired to replace slender presser cheeks by presser cheeks of thicker dimensions when, after the rock or concrete has been opened up, it is necessary to broaden the gap formed. Thus, under these circumstances replacement usually takes place at the work site or quarry and for this reason, should be simple and quick to effect.

SUMMARY OF THE INVENTION

Accordingly, underlying the present invention is the object of providing an apparatus of the type referred can be more easily and more simply replaced under all working conditions. It is an essential condition for use of an apparatus of this kind that its weight and dimensions remain small in spite of the high loads which the apparatus must sustain, so that the latter can be operated by a workman.

According to the invention this object is realised by arranging a transverse web at the lower end of the cylinder, preferably in tubular extension projecting from the piston-cylinder assembly, this transverse web engaging below the head parts of the presser cheeks and being provided with an opening, the head parts being susceptible of being guided through this opening oppositely to the working direction and, preferably by rotating the said head parts, to cause them to be locked or engaged behind the transverse web.

This solution affords the advantage that the presser cheeks can be very simply introduced upwardly into the cylinder or into the tubular extension and locked in position by rotating the presser cheeks.

In this arrangement the slider wedge is, conveniently, fixed in position by suspending it from the free end of the piston rod, so that the slider wedge can be swivelled and the presser cheeks successively disengaged from their locked position by rotating them, whereupon these presser cheeks can be removed from the apparatus.

The hinged connection between slider wedge and piston rod also affords the advantage that the slider wedge together with the presser cheeks can be inclined relative to the axis of the piston-cylinder assembly, without obstruction, whereby breakage or fracture can be in a large measure avoided in the vicinity of the presser cheeks, the slider wedge or the piston rod when the apparatus is asymmetrically loaded.

According to a further proposal the slider wedge is releasably attached to the piston rod. The slider wedge can then be repaired when it becomes worn or, subject to other requirements, replaced by a differently dimensioned slider wedge.

With a view to causing the presser cheeks to lie in contact with the slider wedge in all positions, one or more resilient elements may be provided which resiliently locate and center the presser cheeks in the vicinity of the transverse web.

Preferably, the resilient elements are adapted to be so rotated or swivelled that the presser cheeks can be removed from the tubular extension after they have been released from their locked condition.

The presser cheeks can be suspended and locked in position in a particularly favourable manner by giving the head parts of the presser cheeks a T-shape. Conveniently, the neck portion of the presser cheeks is tapered below the head parts of the presser cheeks. In this way not only is the resilience of the cheeks increased and the vulnerability to fracture reduced, but this expedient also enables the supporting surface of the head parts of the presser cheeks to be increased without necessitating any alteration in the overall cross-section of the tubular extension.

According to a further feature of the invention the head parts of the presser cheeks can be supported, above and below, by two pairs of substantially semi-circular supporting plates which preferably have abutments which, in co-operation with the resilient elements, center the presser cheeks.

DESCRIPTION OF THE DRAWINGS

Two forms of rock breaking apparatus according to the invention are hereinafter described, by way of example, in the accompanying drawings, in which:

FIG. 5 is a longitudinal sectional view of a second embodiment of the apparatus according to the invention, both presser cheeks being shown in their operative position;

DESCRIPTION OF PREFERRED EMBODIMENTS

Figure 1:
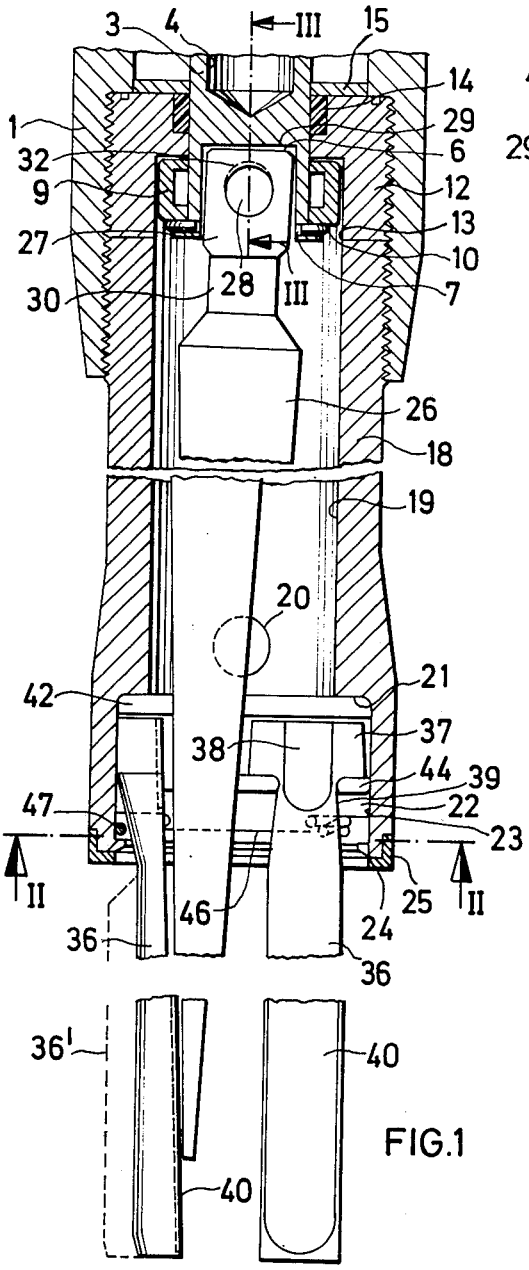
FIG. 1 is a longitudinal sectional view of a first embodiment of the apparatus according to the invention, the left-hand presser cheek being shown in the operative position and the right-hand presser cheek positioned for replacement.

In the embodiment illustrated in FIG. 1, a piston rod 3 is downwardly guided through a bore of cylinder cover element 12 which constitutes a lower closure of a hydraulic cylinder 1 (only partly shown). A ring seal 14, present in the cylinder cover element 12 and serving to seal off the piston rod 3, is itself covered by a ring 15.

Piston rod 3, shown in its upper end position in FIG. 1, is provided with a guide member 9, which in its end position is received in an internally recessed portion of the cylinder cover element 12, this recessed portion being machined on a lathe. In the embodiment illustrated, the guide member 9 is releasably fixed to the lower end of the piston rod 3 by means of a resilient clamping ring 10. This clamping ring 10 has extension portions which are attached to the piston rod 3.

Figure 3:
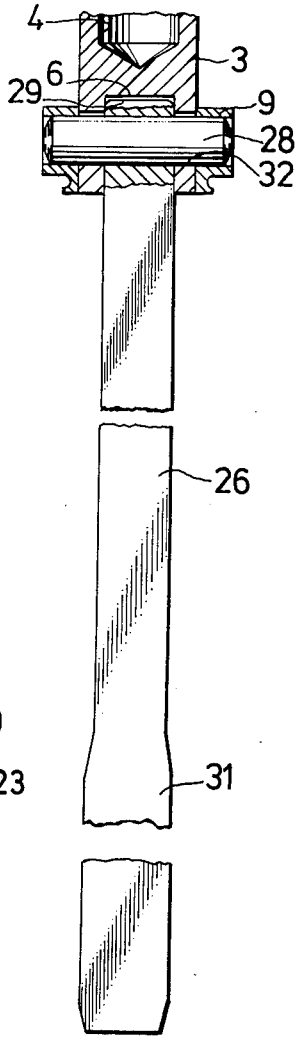
FIG. 3 is a longitudinal sectional view through the piston rod and slider wedge of the apparatus, this view being taken along the line III — III of FIG. 1.

As is clear from FIGS. 1 and 3, a slider wedge 26 is suspended by its head 27 from within a recess in the lower end of the piston rod 3 by means of a pin 28 which, at the same time, passes through the guide member 9 and thus secures the latter in position. The suspended slider wedge 26 is capable of rocking movements owing to the fact that the cross-section of the recess of the piston rod 3 which receives the head 27 of the slider wedge 26 is greater than that of the head 27 itself. Also, the bores of the piston rod 3, through which the pin 28 passes, have elongations 32. Owing to this provision the pin 28 is, during operation of the said apparatus, relieved of load, the head 27 of the slider wedge 26 being supported, by its upper surface 29, on a co-operating support surface 6 of the piston rod 3. However, during the return movement of the piston rod 3, the slider wedge 26 is entrained by the transverse pin 28. For achieving a greater resilience in the upper end region a reduced neck portion 30 is provided (FIG. 1) between the stem and the head of the slider wedge 26. The slider wedge 26 is widened at it lower end 31, so as to give it a spade-like shape and improved lateral guidance.

As shown in FIG. 1, an internally screw-threaded portion of the cylinder 1 is downwardly prolonged for receiving the cylinder cover element 12 and is also used for attachment of a tubular element 18 which consists of aluminium and is screwed upwardly into the cylinder 1 until it abuts against the cylinder cover element 12. The tubular element 18 has an inner bore 19 having a diameter which coincides with the recess machined in the cylinder cover element 12. When the slider wedge 26 is advancing, that is to say moving downwardly, this inner bore 19 guides the guide element 9 at the lower end of the piston rod 3.

For changing the slider wedge 26, the piston rod is moved downwardly until the pin 28 lies in front of a transverse bore 20 formed in the tubular element 18. The tubular element 18 has a smaller transverse bore in its opposite wall, although this smaller bore is not visible in this longitudinal sectional view. Both of these transverse bores are, in their normal condition, closed off, for example by screws, but a plastics plug or the like can be used to close the smaller transverse bore (not shown). After both of these transverse bores have been freed, the pin 28 can be pushed through the larger transverse bore 20 by means of a plunger or the like which has been inserted through the smaller transverse bore. The slider wedge 26 can now be pulled out, and may be replaced.

The manner in which the slider wedge 26 is supported by suspending it from the piston rod 3 assists the process whereby the presser cheeks can be replaced, as will be apparent from the following description. It also prevents fracture or breakage when the presser cheeks assume an inclined position with respect to the cylinder 1 during operation of the said apparatus.

Each of the two presser cheeks 36 — which are replaceable and can be introduced into the tubular element 18 from below for the purpose of suspending them — has, following a tapered neck portion 39, a T-shaped head part 37, which is provided with a facing 38, made of a hard metal, on its inner face. The tapered surfaces of the two presser cheeks 36, which are in contact with the slider wedge 26, are also provided with a facing 40 of a hard metal.

Figure 2:
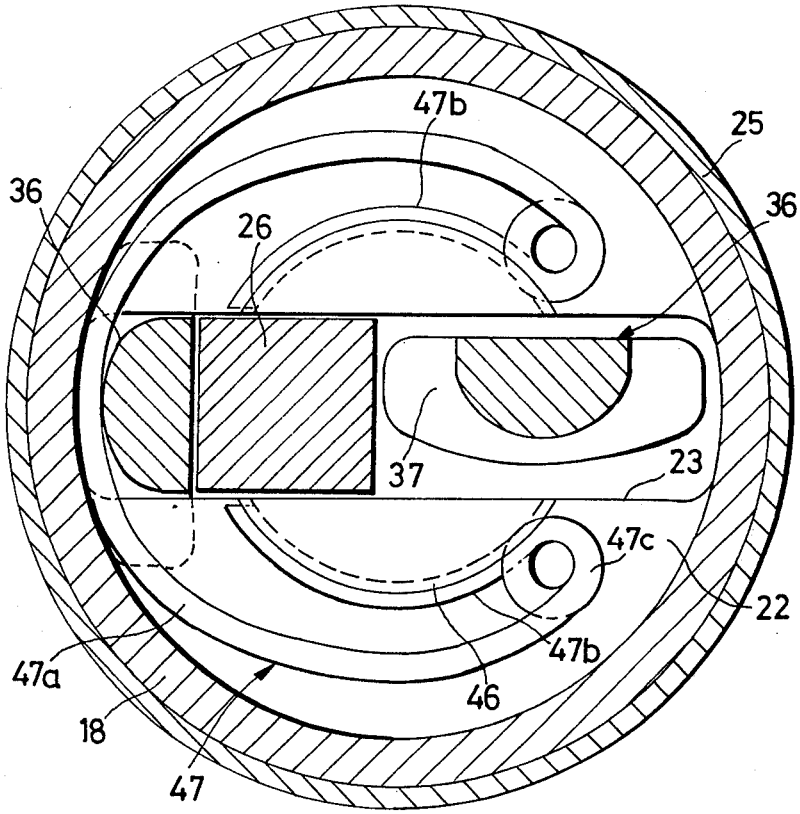
FIG. 2 is a transverse cross-sectional view taken along the line II — II of FIG. 1.
Figure 4:
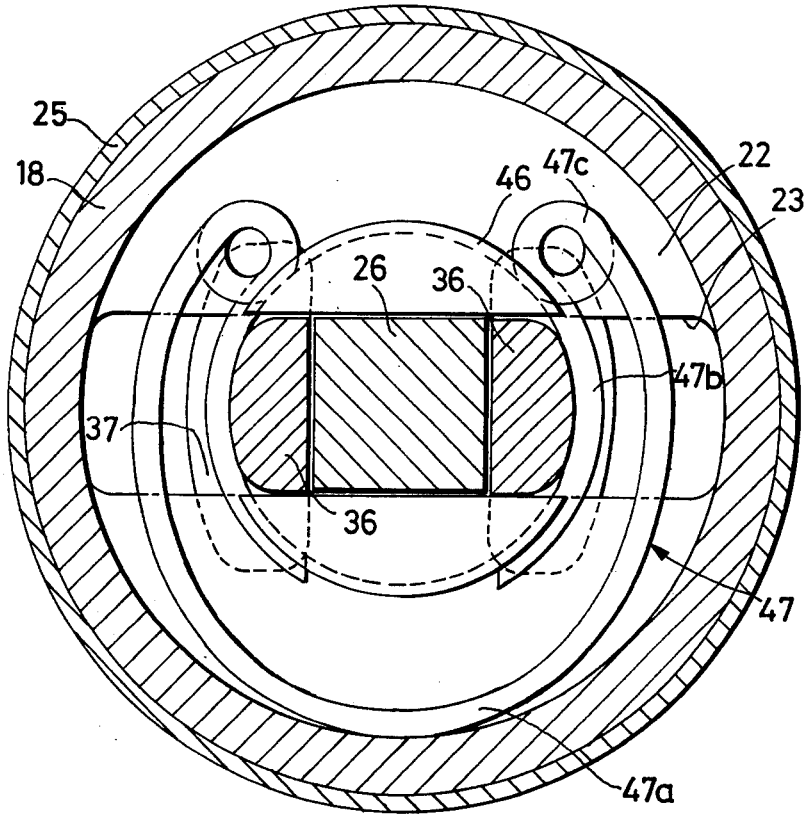
FIG. 4 is a transverse cross-sectional view which is similar to that of FIG. 2; however in this figure both presser cheeks are shown in their operative position.

In FIGS. 1 and 2 the left-hand presser cheek only is in a position in which it is ready for operation, the right-hand presser cheek in FIGS. 1 and 2 being shown after they have been turned through an angle of 90°, so that they can be drawn downwardly from out of the tubular element 18. In FIG. 4 both presser cheeks 36 are shown in readiness for operation.

The presser cheeks 36 are positioned with their head parts 37 in a machined recess, formed in the lower end of the tubular element 18. This machined recess defines a shoulder 21; positioned opposite and at a distance from this shoulder 21 are an intermediate web 22, which is provided with an elongate opening 23 (as shown in FIGS. 2 and 4), and a projection 24 which resembles a neck and lies at the outer end of the tubular element 18. For improving the mechanical stability the lower end of the tubular element, which is of aluminium, is enveloped with a protective ring 25, made of steel.

Serving as upper support for the head parts 37 of the presser cheeks 36 are two substantially semicircular supporting plates 42, which are upwardly supported by the shoulder surfaces 21 of the tubular element 18. Similarly, the head parts 37 of the presser cheeks 36 are supported in the downward direction by two substantially semicircular supporting plates 44, which lie to either side of the presser cheek 23 on the intermediate web 22 of the tubular element 18. These supporting plates 42 and 44 absorb all axial forces of the presser cheeks 36, although they allow the T-shaped head parts 37 of the presser cheeks 36 a sufficient clearance to ensure that both the presser cheeks themselves and also the slider wedge 26 can assume limited positions of inclination relative to the tubular elements 18. By reason of the high specific pressures involved, the supporting plates 42 and 44 should be made of hardened steel. Conveniently, the steel supporting plates may be provided with a facing of hard metal, so that they combine a high resistance to abrasion with excellent resilience. For securing the presser cheeks in position, and also for centering them, these presser cheeks 36 are engaged, below their head parts 37, by a resilient element 47 which has been inserted into the lower opening of the tubular element 18 and is swivelably mounted behind an outer collar 46 of the intermediate web 22. In FIG. 2, the resilient element 42 is shown in the position required for releasing the presser cheeks 36, whereas in FIG. 4 it is shown in its operative position. The resilient element 47 consists of spring steel wire and is bent so as to form an arcuate portion 47 which is connected, by way of coiled portions **47*c*, to arms 47*b* which pass round the outer collar 46. As can be seen in FIG. 1, the arcuate portion 47*a* of the resilient element 47 lies in a lower plane than the two inner arms 47*b*. Thus, in the operative position shown in FIG. 4, in which the slider wedge 26 is in its outwardly advanced (i.e. downwardly shifted) position, the arcuate portion 47*a* can deform so as to engage the wall of the machined recess in the tubular element 18.**

The supporting plates 42 and 44 may comprise abutments against which the head parts 37 of the presser cheeks 36 are applied, subject to the biasing force of the resilient element 47, so as to center the presser cheeks 36. These abutments which are similar to the abutments 75 in FIG. 6, may be formed integrally with the supporting disc halves 42 and 44, or welded or screwed thereto.

If the presser cheek 36 is to be removed, resilient element 47 is first of all rotated until it assumes the position shown in FIG. 2; the right-hand presser cheek 36 (as shown in FIGS. 1 and 2) is also rotated through an angle of 90°, whereupon this right-hand presser cheek 36 can be downwardly withdrawn. The left-hand presser cheek can also be similarly rotated and removed. During this operation the rockingly suspended slider wedge 26 is laterally swivelled to the appropriate side for allowing removal of the particular presser cheek concerned. Installation of the presser cheeks takes place with the opposite sequence of operations.

By virtue of the simple and robust manner in which the presser cheeks are suspended, it is readily possible, after breaking up a portion of rock being worked on, to replace the presser cheeks 36 by presser cheeks 36' which are of thicker dimensions, the replacement presser cheeks 36' being shown in broken outline in FIG. 1. The gap formed in the said portion of rock can then be widened with the replacement presser cheeks 36'.

The lower end 31 of the slider wedge 26 which is widened (as mentioned above) so as to be formed with a spade-like shape, ensures that the slider wedge 26 will still be in contact with the sliding surfaces of the presser cheeks 36 when it is intended to shift the slider wedge 26 laterally with respect to these sliding surfaces of the presser cheeks 36. Circumstances may occur in which this relative positioning of the slider wedge 26 and presser cheeks 36 may be necessary. In this way uniform loads will be applied per unit area of surface under all working conditions.

Figure 6:
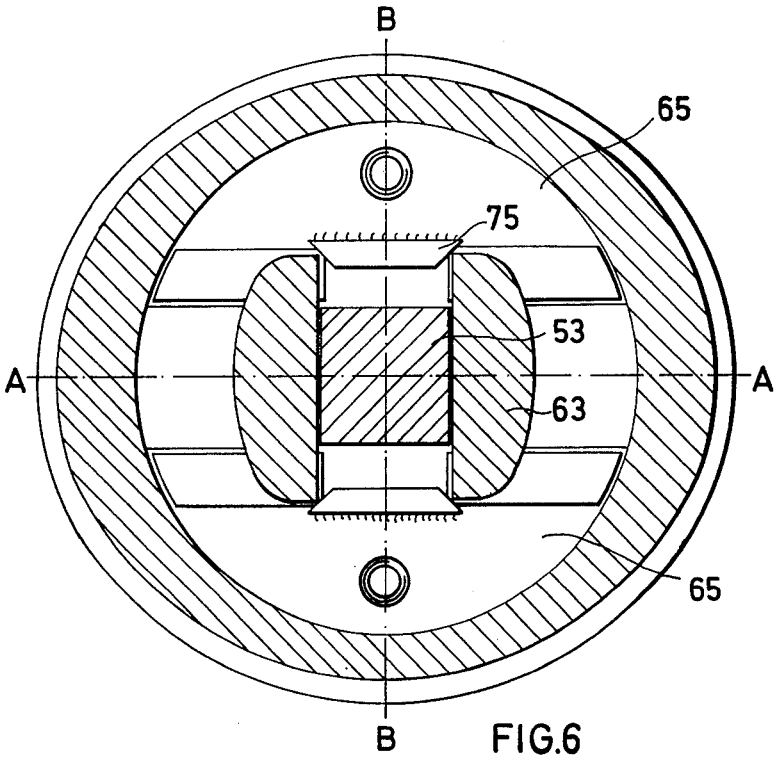
FIG. 6 is a transverse section of the apparatus taken along the line VI — VI of FIG. 5.
Figure 7:
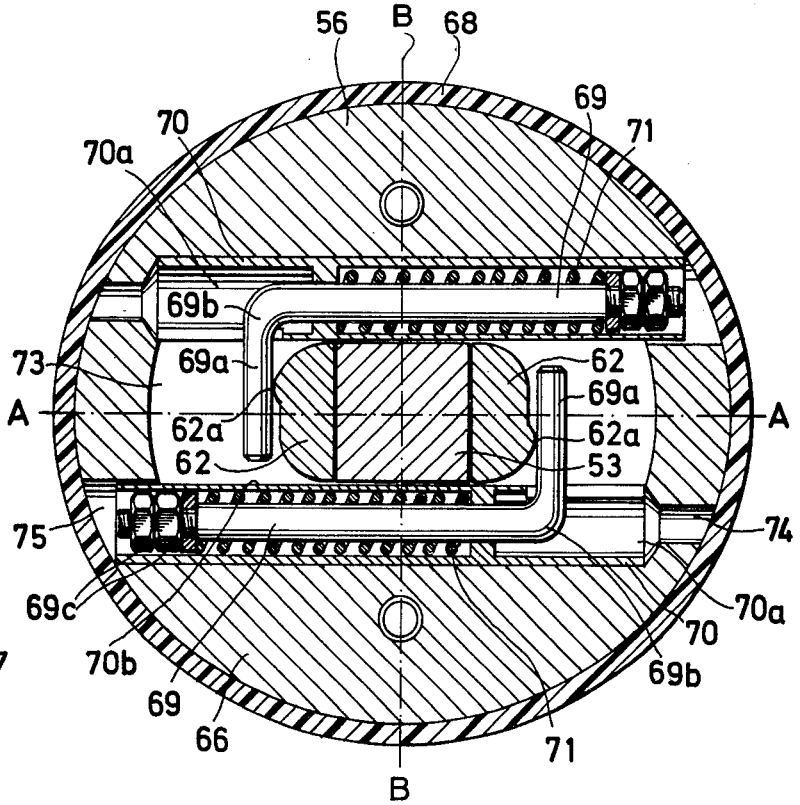
FIG. 7 is a transverse cross-sectional view of the apparatus taken along the line VII — VII of FIG. 6.

The basic structure of the second embodiment of the invention, shown in FIGS. 5 to 7, is similar to that of the previous embodiment, so that the following description is substantially restricted to pointing out the differences.

In this second embodiment of the invention also, there is a piston (not shown) which is shiftable within a cylinder 50 and connected to a slider wedge 53 by way of a piston rod 51 (which is formed with a central bore 52) and by means of a transverse pin 54. A somewhat differently constructed guide member 55 guides the lower end of the piston rod 51 in the bore of a tubular element 56. This tubular element 56 is screwed upwardly into the extension of a cylinder 50 until it abuts against a cylinder cover element 57 which is differently constructed from the equivalent part used in the previous embodiment. Sealing rings 58 to 59 co-operate with a cover ring 60 for providing a seal in the downward direction for the cylinder space. A wiper ring 61, which is inserted into the cylinder cover element 57, clears the piston rod 51 of entrained dirt during the return movement of the piston rod 51.

Presser cheeks 62 are suspended by their T-shaped head parts 63 in the lower end of the tubular element 56. The head parts 63 of the presser cheeks 62 are supported in the upward direction by substantially semicircular supporting plates 64 and, in the advancing or downward direction of the slider wedge 53, bear against the substantially semicircular supporting plates 65, which somewhat resemble a roof in shape and are in turn supported by a transverse web 66 of the tubular element 56. The supporting surfaces 67 of the supporting plates 65 slope downwards from the center to the sides and are preferably hardened at their surface portions. Owing to the inclination of the supporting surfaces 67, the frictional forces, effective transversely of the advancing or downward direction of the slider wedge 53, are reduced during this advancing phase of the operation of the slider wedge 53. In order to prevent damage when the lower end of the tubular element 56 rests on the surface of the rock to be broken up, the tubular element 56 is provided at its lower end with a protective cap 68 which preferably consists of a resilient rubber material.

An important difference of the apparatus shown in FIGS. 5 to 7 concerns the resilient elements which center the presser cheeks 62 in their rest position. As shown particularly in FIG. 7, these resilient elements consist of pins 69, which are shiftable — transversely of the advancing direction of the slider wedge 53 and against the biasing force of helical springs 71 — within steel sleeves 70. The pins 69 have bent-over ends **69*a* which bear against the outer faces of the presser cheeks 62. In this region the presser cheeks 62 comprise projections 62*a* which are eccentrically offset towards the shanks of the pins 69. This enables the point of contact between each presser cheek 62 and the end 69*a* of the engaging pin 69 to be placed as close as possible to the elbow or bend in the pin 69, so that the binding forces effective at the end 69*a*** of the pin are kept small owing to the lever arm being shortened.

The sleeve ends **70*a* are provided with openings in the vicinity of the bent-over endss 69*a*. This opening both enables the pin to be laterally shifted against the biasing force of the spring 71** and also to be swivelled about its central axis.

The latter-mentioned provision is of use when the presser cheeks 62 have to be released for removal of the presser cheeks 62 from the apparatus. Under these circumstances the ends **69*a* are downwardly swivelled, so that the presser cheeks 62 — which are no longer biased by the tensioned springs 71 — are swivelled about their longitudinal axes and may be withdrawn through a center slot 73 formed in the transverse web 66 which supports the head part 63 of the presser cheeks 62. As is also clear from FIG. 7, the inner surfaces 70*b* of the sleeves 70 silultaneously form lateral guide surfaces for the slider wedge 53 and for the presser cheeks 62. For this reason the sleeves 70, which are preferably exchangeable, consist of a more resistant material (for example steel) than the tubular element 56, which is made of aluminium. It is thus possible, in a simple manner and after a certain period of operation of the sleeves 70, to remove and replace the latter. With this in view it is merely necessary to loosen the fixing and lock nuts 69*c* of the pin, to remove the protective cap 68, and to remove the sleeves 70, through the slot 73, by means of a pin which has been inserted into a transverse bore 74.**

As shown in FIG. 6, abutments 75 have been welded to the supporting plates 65. The head parts 63 of of the presser cheeks 62 bear, in the rest position, against the ramped ends of these abutments 75 subject to the biasing force of the springs 71 which co-operate with the pins 69 for this purpose. These abutments 75 thus cooperate with the spring-loaded pins 69 to ensure that the presser cheeks 62 will, in the retracted position of the slider wedge 53, always be positioned symmetrically with respect to the central axis of the apparatus, and will thus assume an optimal starting position for each working cycle.

Further, as shown in FIGS. 6 and 7, the cross-section of the lower end of the tubular element is of oval or elliptical shape. As the structure of the tubular element is weakened to a greater extent in the vicinity of the apex points A (owing to the presence of transverse bores and other cutaway portions) than in the vicinity of the apex points B, the tubular element is of oval shape and is given a thicker wall in the apex regions A than in the apex regions B. By virtue of this provision the apparatus, proposed according to the invention, for breaking up rock, can be subjected to greater loads without a corresponding increase in weight.

For a similar reason the presser cheeks 62 are relieved to form notches for receiving the pin ends 69*a* which, in their working positions, bear against the outside surface of the presser cheeks. These notches allow the presser cheeks 62 to be transversely shifted, subject to the effect of the slider wedge 53 (which is in its outwardly or downwardly extended position), as far as possible without being obstructed by the pin ends 69*a*. Accordingly, optimal use is made of the maximum possible transverse stroke without enlarging the proposed apparatus for breaking up rock.

The presser cheeks 62 may, if desired, be replaced by presser cheeks 62', which are shown in dashed outline and are of thicker dimensions. These presser cheeks 62 are outwardly prolonged beyond their sliding surfaces, which are preferably reinforced by facings 62*a* made of hard metal. These prolonged or extended portions 62*b* enable the presser cheeks 62 to penetrate the furthest possible distance into the drill hole formed in the rock, and to fully exploit the capacity of the proposed apparatus for breaking up rock.

In both of the embodiments described above, the slider wedge and the presser cheeks can be individually released and replaced without having to remove the tubular extension which supports the presser cheeks.

To reduce weight, the piston and cylinder of the piston-cylinder assembly may be of aluminum and the piston rod, which is of steel, is provided with a central cavity (4 or 52).

I claim:

1. Apparatus for mechanically breaking up rock comprising a hydraulic piston-cylinder assembly, a tubular extension projecting from the cylinder of the piston-cylinder assembly, a web extending transversely within the outer end of the tubular extension to define an elongate opening, a piston rod extending from the piston of the piston-cylinder assembly, a slider wedge which has convergently inclined bearing surfaces and is reciprocable within the tubular extension by the piston rod said slider wedge being releasably and pivotably connected to said piston rod, presser cheeks which are releasably mounted for lateral movement within the tubular extension and have bearing surfaces for complementary engagement with the convergently inclined bearing surfaces on opposite sides of the slider wedge, and head portions of the presser cheeks for insertion in the opening defined by the transverse web of the tubular extension at a predetermined orientation of said cheeks about their axes and upon rotation of the presser cheeks about their axes the heads are locked within the tubular extension behind the transverse web.

2. Apparatus according to claim 1, in which resilient means act on the presser cheeks in the vicinity of the transverse web to resiliently locate and center the presser cheeks, and the resilient means are rotatable in a circular groove in the transversely extending web of the tubular extension.

3. Apparatus according to claim 1, in which resilient means act on the presser cheeks in the vicinity of the transverse web to resiliently locate and center the presser cheeks, and the resilient means comprise two centering pins, the centering pins have shank portions which extend transversely of the axis of the tubular extension and bent ends which project perpendicularly from the shank portions for lateral engagement with the presser cheeks, respectively, and springs which respectively engage the shank portions of the centering pins to press the bent ends into engagement with the presser cheeks.

4. Apparatus according to claim 3, in which each centering pin is rotatable about the axis of its shank portion for alignment of the axis of the bent end parallel to the axis of the tubular extension to allow removal of the presser cheeks.

5. Apparatus according to claim 3, in which each presser cheek is shaped so as to engage the bent end of one of the centering pins at a portion of the periphery of the presser cheek which is closer to the shank portion of the centering pin than a portion of said periphery around an axial plane extending parallel to the axes of the shank portions mid-way between the axes of the shank portions.

6. Apparatus according to claim 3, in which the shanks of the centering pins are movable mounted in steel bushes which are embedded in the tubular extension.

7. Apparatus according to claim 1, in which two pairs of supporting plates respectively engage the axially opposite heads of the presser cheeks, the two pairs of supporting plates supporting abutments for centering the heads of the presser cheeks, and the supporting plates having wear resistant surfaces.

8. Apparatus according to claim 7, in which the outermost pair of supporting plates have supporting surfaces which are inclined to a plane which is perpendicular to the axis of the tubular extension and diverge outwardly.

9. Apparatus according to claim 1, in which the slider wedge and the piston rod are connected by a dowel pin which is removably seated in holes formed in the slider wedge and the piston rod, at least one of the holes being elongated along the axis of movement of the slider wedge to allow axial abutment between the slider wedge and the piston rod, to avoid shear loading on the pin, on outward movement of the piston rod.

10. Apparatus according to claim 9, in which the tubular extension is provided with aligned transverse bores for removal of the dowel pin.

11. Apparatus according to claim 1, in which a guide sleeve is removably attached to the piston rod to guide the piston rod along the internal surface of the tubular extension.

12. Apparatus according to claim 1, in which the outer end of the tubular extension, around the transversely extending web, is of oval-shaped cross-section, the elongate opening extends along the major axis of the oval-shaped cross-section, and the wall-thickness of the tubular extension varies from a minimum at the ends of the minor axis of the oval-shaped cross-section to a maximum at the ends of the major axis.

13. Apparatus according to claim 1, in which the outer end of the slider wedge is broadened transversely of the convergently inclined bearing surfaces.

* * * * *